US005433161A

United States Patent [19]

Loui

[11] Patent Number: 5,433,161

[45] Date of Patent: Jul. 18, 1995

[54] SWAS VESSEL

[75] Inventor: Steven Loui, Honolulu, Hi.

[73] Assignee: Pacific Marine Supply Co., Ltd., Honolulu, Hi.

[21] Appl. No.: 159,596

[22] Filed: Dec. 1, 1993

[51] Int. Cl.[6] ..... B63B 1/00

[52] U.S. Cl. ..... 114/61; 114/265

[58] Field of Search ..... D12/308, 304, 309; 114/61, 56, 57, 67 A, 67 R, 274, 2665, 264, 123

[56] References Cited

U.S. PATENT DOCUMENTS

| | | | |
|---|---|---|---|
| 1,817,780 | 8/1931 | Stack | 114/61 |
| 3,430,595 | 3/1969 | Tulleners | 114/67 R |
| 4,763,596 | 8/1988 | Yoshida | 114/61 |
| 4,869,192 | 9/1989 | Pawolski | 114/265 |
| 4,987,846 | 1/1991 | Yamashita et al. | 114/265 |

FOREIGN PATENT DOCUMENTS

| | | | |
|---|---|---|---|
| 631381 | 11/1978 | U.S.S.R. | 114/61 |

OTHER PUBLICATIONS

1976 "Motorboat" The Tulleners Wave Piercing Craft.

*Primary Examiner*—Edwin L. Swinehart

*Attorney, Agent, or Firm*—Fitzpatrick, Cella, Harper & Scinto

[57] ABSTRACT

A small water plane area vessel is disclosed which includes at least one normally submerged hull, a superstructure normally located above the level of the water during operation of the vessel and at least one strut connected between the superstructure and the submerged hull. The vessel has a design draft water line located between the normally submerged hull and the superstructure and at lease one buoyancy pod on the strut located above the design draft water line and below the superstructure. The strut has a water plane area at the water plane of the pod which is larger than the water plane areas thereof above and below the pod.

31 Claims, 7 Drawing Sheets

SWAS VESSEL

BACKGROUND OF THE INVENTION

1. Field of the Invention

The present invention relates to small water plane area vessels (also referred to "SWAS" vessels) and more specifically to a SWAS vessel having improved hydrodynamic stability, low water resistance, and minimal ship motion.

2. Background of the Invention

Small water plane area ships (SWAS) generally consist of a vessel having at least one water line located below its design draft with a water plane area that is significantly larger than the water plane area at its design draft. One form of such vessel is a small water plane twin hull vessel (also referred to as a SWATH vessel) which generally consists of two submerged hulls, originally formed of uniform cross section, connected to a work platform or upper hull by elongated struts which have a cross section along any given water plane area that is substantially smaller than a water plane area cross section of the submerged hulls. Thus, at the design water line, with the hulls submerged, such vessels have a small water plane area.

SWAS vessels may have one or more lower hulls connected to the work platform or super structure by one or more struts. Originally, SWAS vessels utilized single struts between two submerged hulls and the upper platform, as shown for example in U.S. Pat. Nos. 3,447,502 issued to Lang, and 4,552,083 issued to Schmidt. Some time ago, however, the Naval Ocean System center at San Diego and Honolulu developed a SWAS design characterized by having a least two struts associated with each submerged hull. These vessels are further characterized by submerged twin hulls with uniform cross sections and at least two narrow struts making a connection, at the forward and aft ends of the submerged hulls and the platform. These struts typically extend vertically, as shown for example in U.S. Pat. Nos. 3,623,444 and 3,897,944, issued to Lang. Other forms of such vessels have been disclosed which contain a single lower hull connected by one or more struts to the work platform and vessels having three or more lower hulls connected to the work platform by one or more struts associated with each hull.

SWAS vessels of this type usually include sponsons (alternatively referred to in the art as upper hulls or upper struts) which are structures positioned above the struts and below the work platform or the super structure that have significantly increasing water plane areas extending from the strut to the platform. That is, these sponsons are flared hull type structures in cross section having deadrises extending along the length of the vessel. The sponsons may be continuous or segmented over each strut. The struts themselves are generally foil shaped and constant in cross sectional areas. However, as is known in the art, these struts can also be tapered and/or can be canted at negative or positive diehedral angles.

In SWAS vessels, it is desirable to maintain a minimum water plane area at the design water line for most efficient operation of the vessel. However, this desirable goal is limited by the need for a minimum water plane area required to maintain hydrostatic stability. As a result, existing SWAS vessels commonly have a problem with trim and heel stability due to the small water plane area of the struts. These vessels also suffer from high frictional drag due to relatively large surface areas formed by the struts despite every effort that has been made to minimize this.

It has been found desirable that the aft sections of the submerged hull in SWAS vessels be streamlined in order to improve propulsion efficiency. However, streamlining the lower hulls (i.e. tapering their aft sections) causes significant losses in buoyancy at a position in a vessel where it is usually essential.

The use in SWAS vessels of sponsons having greatly flared cross sections with low to moderate deadrise has been proposed in order to meet static and damage hydrostatic ability requirements. In other words, should the vessel be compromised and take on water, as the submerged hulls and struts sink in the water, the sponsons engage the water surface to increase buoyancy of the entire vessel. However, the presence of the sponsons, which are located above the water line during normal operation of the vessel, create slamming in high seas and contributes to increased ship motion and resistance in heavy weather. Such slamming can of course cause significant structural damage.

Although SWAS vessels have been found to be highly desirable in a number of applications, the above problems present a continuing need for improved design. Thus, it has been found that there is a need to have a simple and cost effective way to modify the location of the centers of gravity, buoyancy and flotation in such vessels under various operating conditions. It is further desirable to provide adequate water plane area for such ships which generally have multiple design operating drafts.

It is an objective of the present invention to provide a simple and cost effective way to modify the centers of gravity, buoyancy and flotation of SWAS vessels under various operating conditions.

Another object of the present invention is to provide a reduced water plane area for SWAS vessels which have multiple design operating drafts.

Yet another object of the present invention is to reduce ship motions in SWAS vessels in order to advantageously exploit the Froude Krylov forces acting on such vessels.

A further object of the present invention is to reduce SWAS vessel motions through added mass and viscous damping.

Yet a further object of the present invention is to reduce wetted surface area in SWAS vessels while maintaining adequate displacement.

A still further object of the present invention is to provide an improved SWAS vessel.

Another object of the present invention is to provide a SWAS vessel in which the geometric conditions of the vessel call be modified to obtain improved operating conditions.

SUMMARY OF THE INVENTION

SWAS vessels are characterized by good sea keeping. This benefit is obtained by having the smallest water plane area located at the design water line of the vessel while still providing hydrostatic stability, low resistance and minimum ship motions. By having small water plane areas at the design draft or water plane line, the vessel is less effected by wave excitation forces and this contributes to the reduction in ship motion and the increased effectiveness of the stabilization systems of the vessel to improve sea keeping. Moreover, with shorter strut chord lengths or aspect ratios from the water line down, the water plane area is reduced further, along with the total strut wetted surface area, with the result that there is a reduction in frictional resistance forces applied to the vessel during operation. The use of narrow struts to reduce the water plane area also produces less wave making resistance.

The present invention deals specifically with the provision of strategically placed, streamlined elongated pod like structures incorporated as part of the struts of a SWAS vessel in order to produce localized increases to water plane area and displacement. The buoyancy pods of the invention are located such that the water plane area of the struts immediately above and below the pods have a smaller water plane area than the water plane area of the strut at the water lines at which the pod is located. The pods above the water line are designed to be "wave piercing" when the vessel encounters unusually high seas.

The pods may be formed in a variety of shapes and dimensions, calculable by a skilled ship designer, to achieve the desired buoyancy characteristics described hereinafter. Preferably the buoyancy pods are located above the design water line, but they also may be located below the design water line in particular applications. In addition they may be located at multiple locations on the struts of the vessel to produce multiple design operating drafts. The struts themselves need not be symmetrical, above and below the buoyancy pods, and preferably have a greater cord length above the pod than below the pod.

The buoyancy pods also can be symmetrically or nonsymmetrically positioned on the struts which respect to the vertical, transverse and horizontal planes, as design parameters require. They may take a variety of shapes and constitute full pods which completely encompass the strut, or they may be sections of pods located at the forward or aft end of the struts, or on the sides of the struts, again depending upon design criteria. The pods are shaped to minimize resistance in movement through the water, minimize slamming in waves, and to have wave piercing characteristics. They can also be designed to minimize wetted surface area and to minimize or deflect spray.

In accordance with an aspect of the present invention, a small water plane area vessel includes a plurality of normally submerged hulls, a super structure normally located above the level of the water during operation of the vessel and a plurality of struts connecting the super structure to the submerged hull. These struts include at least one strut connecting each hull to the superstructure, although multiple struts may be provided between each hull and the superstructure.

The vessel has a design draft water line located between the normally submerged hulls and the superstructure and preferably at least one buoyancy pod on at least one of the struts is located above the design draft water line and below the super structure. The strut has a water plane area at the water plane of the pod which is larger than the water plane area of the strut above and below the pod.

The provision of buoyancy pods above the design water line in accordance with the present invention produces water plane area and displacement at a specific location when needed on the strut while permitting the strut to perform with as small a water plane area as possible at the water line and also maintaining sufficient hydrostatic and damage stability. Thus, for example, if weight shifts or the vessel begins to list, the pod will come into contact with the water surface and increase the total buoyancy of the vessel.

The provision of buoyancy pods also reduces the required sponson flare since less buoyancy will be required from the sponson than in previous proposed vessels without buoyancy pods. This also reduces slamming and its negative effects on the vessel.

The provision of buoyancy pods on the struts of SWAS vessels is also effective to position the center of gravity, center of buoyancy, or center of floatation of the vessel. This enhances or corrects the vessels hydrostatic and hydrodynamic characteristics and improves operating characteristics at multiple design operating drafts. The provision of pods at the rear of the vessel on the rear strut adds buoyancy to the ship aft section which enables the lower hulls to be streamlined for flow and propulsive efficiency reasons. The streamlining of the submerged hulls reduces buoyancy at the rear of the vessel which is compensated for by these buoyancy pods.

The provision of buoyancy pods in accordance with the invention also reduces ship motions at rest or underway to help tune the vessel. These reduced motions are the results of added mass and viscus effect dampening of the pods. The reduced motions are also effected through Froude Krylov force cancellation by strategically placed and designed pods positioned to obtain the required characteristics needed to negate forces at design wave frequencies.

Buoyancy pods may be placed below the design water line as a simple way to increase displacement and thus payload. The pods will reduce resistance by providing the equivalent buoyancy of a non-pod strut section but with less surface area. Buoyancy pods positioned above the design draft water line can be designed to effectively reduce spray drag by deflecting spray from the bow wave back to the water. Such pods can be retrofit on existing ships and used as tanks to hold various liquids or filled with foam to satisfy damage stability requirements.

The above, and other objects, features and advantages of this invention will be apparent to those skilled in the art from the following detailed description of illustrative embodiments of the invention which is to be read in connection with accompanying drawings, wherein:

DETAILED DESCRIPTION OF THE PREFERRED EMBODIMENT

Figure 1:
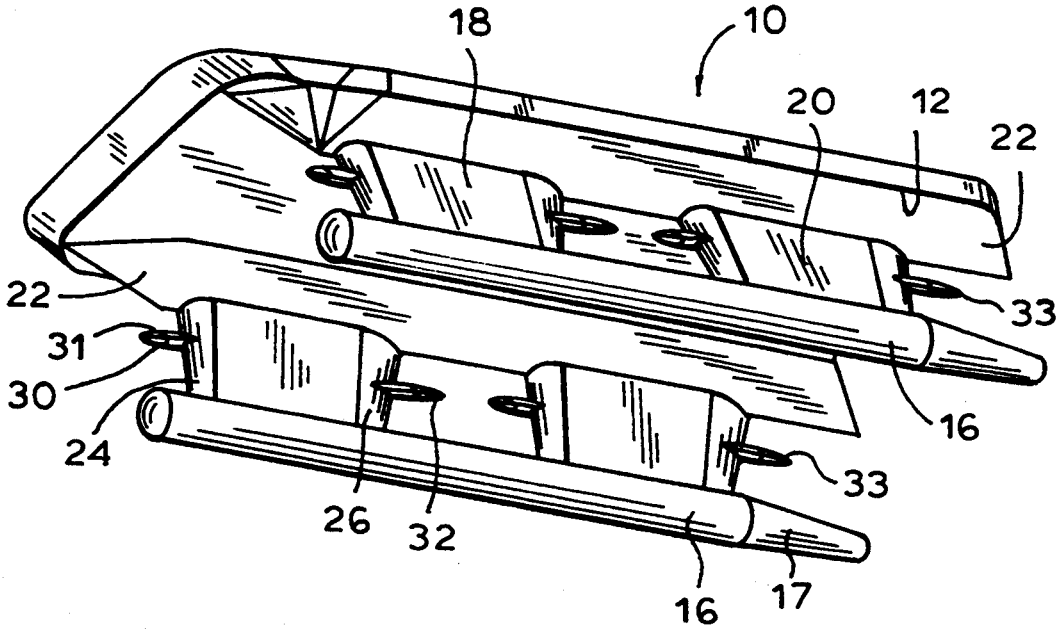
FIG. 1 is a perspective view of a SWAS/SWATH vessel constructed in accordance with the present invention.
Figure 2:
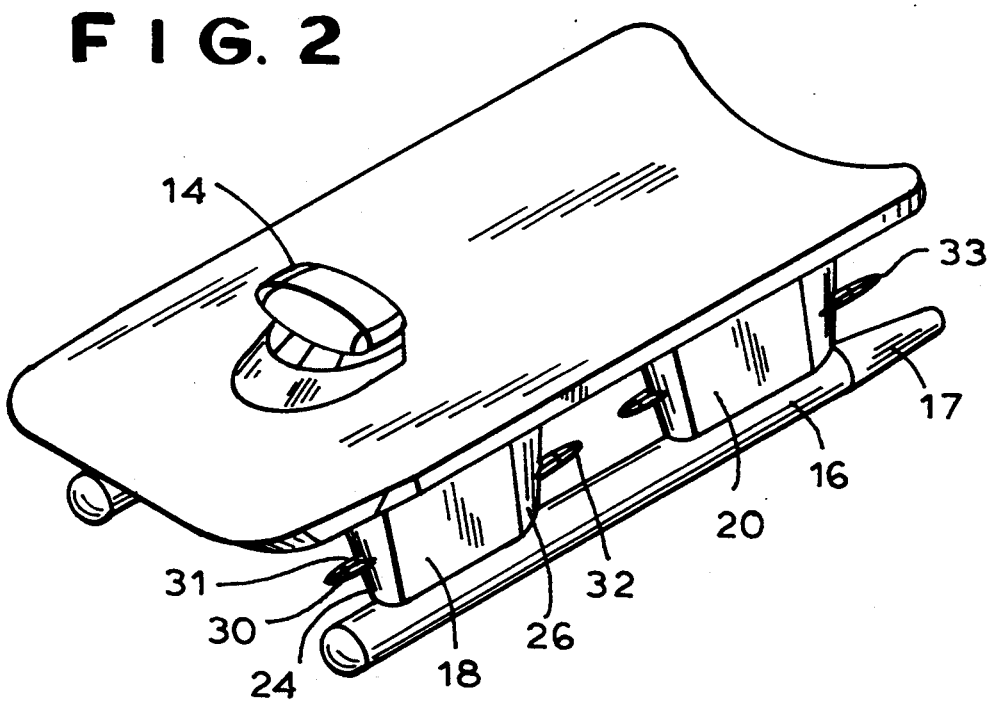
FIG. 2 is a perspective from above of the vessel shown in FIG. 1.
Figure 3:
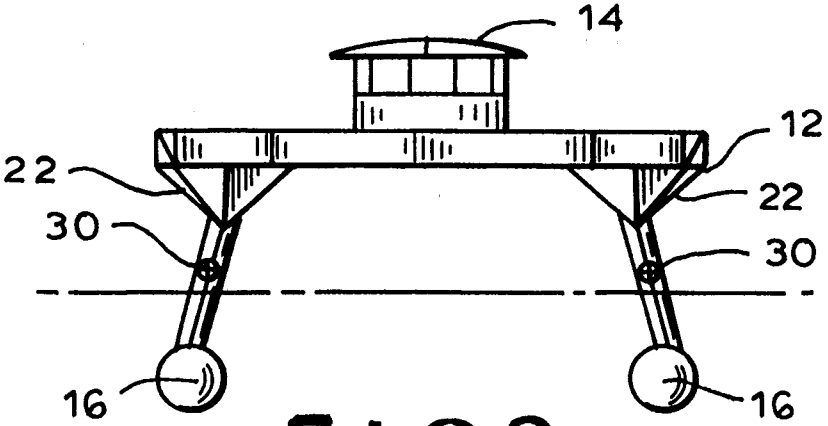
FIG. 3 is a front elevational view of the vessel in FIG. 1.

Referring now to the drawings in detail, and initially to FIG. 1, a SWAS/SWATH vessel 10 of generally known construction is illustrated which includes a main upper platform or hull 12 on which a schematically illustrated superstructure 14 is mounted. The vessel includes a pair of normally submerged hulls 16 and two pairs of struts 18, 20 on opposite sides of the vessel connected between platform 12 and hulls 16. Platform 12 includes a pair of sponsons 22 located on either side of the platform and to which struts 18, 20 are connected. In this illustrative embodiment of the invention sponsons 22 extend the full length of hull or platform 12. The sponsons 22 are flared as illustrated in FIG. 3 in the known manner and provide additional buoyancy to the vessel should the struts become fully submerged. They also encounter waves in unusually high seas to provide increased buoyancy.

Struts 18, 20 may be vertically arranged between sponsons 22 and hulls 16 or they may be angled, as shown in FIG. 3, and as described in U.S. Pat. application Ser. No. 07/903,014 filed Jun. 22, 1992, the disclosure of which is incorporated herein by reference. Preferably the struts are tapered so that their water plane area decreases from their point of connection to sponsons 22 towards hulls 16. The struts are also preferably streamlined in shape, having tapered leading or forward edges 24 and tapered aft or trailing edges 26.

In accordance with the present invention buoyancy pods 30, 32 are provided on struts 18, 20. Buoyancy pods 30 are located at the forward edges of the struts and pods 32 are located on the aft edge of the struts. These pods are rigid hollow members which provide increased buoyancy to the vessel when engaged with the surface of the water.

In the embodiment illustrated in FIGS. 1–4 forward pods 30 have a generally diamond shaped cross section (see FIG. 3) with their forward portions 31 being tapered to a point to define a wave piercing structure. Aft pods 32 have a similar cross-sectional shape and their aft ends 33 are also tapered to a wave piercing point.

The specific dimensions of the pods can be varied as desired by the designer to provide the desired additional buoyancy to the vessel. Preferably forward pods 30 are located above the design water line 35 of the vessel so that, they are above the bow wave formed by the struts as the vessel moves through water under normal operating conditions° Thus the forward pods are normally not in contact with the water during normal operation of the vessel.

Figure 4:
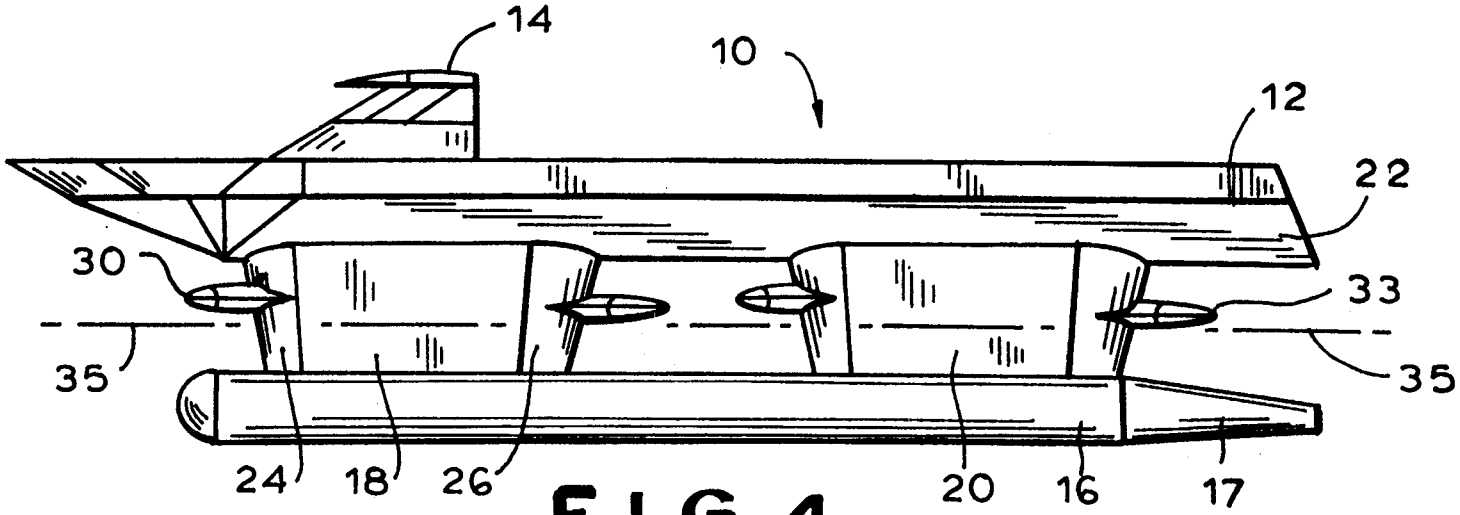
FIG. 4 is a side view of the vessel shown in FIG. 1.

Aft pods 32 are positioned as illustrated in FIG. 4 at a lower water line on the strut than the forward buoyancy pods. This is possible because the characteristic of bow waves in vessels is that a trough is formed behind the strut so that the water level during operation of the vessel is actually lower at the trailing edge of the strut than at the forward edge which forms the bow wave. Thus the rear pod may be lower than the forward pod without contacting the water during operation. Preferably the trailing pods are positioned such that the lower surfaces thereof are ventilated (i.e., slightly spaced) from the trough of the bow wave at normal operating conditions.

The provision of buoyancy pods 30, 32 in this way allows struts 18, 20 to be minimized in size and thickness as far as practical given the general structural and machinery space requirement within the struts. Most importantly, the provision of such buoyancy pods allows the struts to be tapered to reduce the surface area of the struts and thus the friction encountered as they move through the water. Still further, the buoyancy pods permit the aft sections 17 of hulls 16 to be streamlined to maximize propulsion efficiency from good hydrodynamic flows to the propellers since the pods will provide the necessary added buoyancy in the aft sections of the vessel. Moreover, because of the increased water plane area and buoyancy from the pods when encountering unusually high seas, the sponsons of the ship can be designed with less flair (i.e., with less deadrise) thereby minimizing incidents of slamming of the vessel in high seas.

Figure 12:
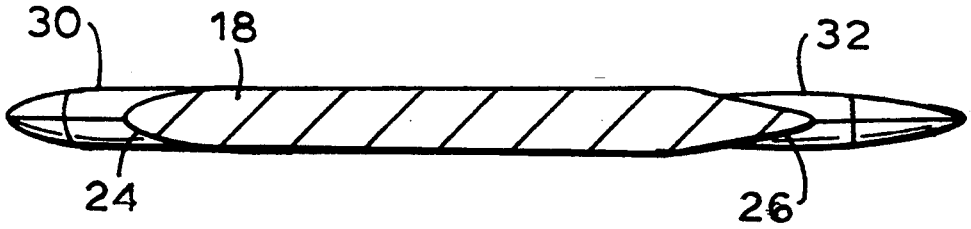
FIG. 12 is a sectional view taken along line 12—12 of FIG. 1 at the central water plane area of the strut through the buoyancy pod.
Figure 14:
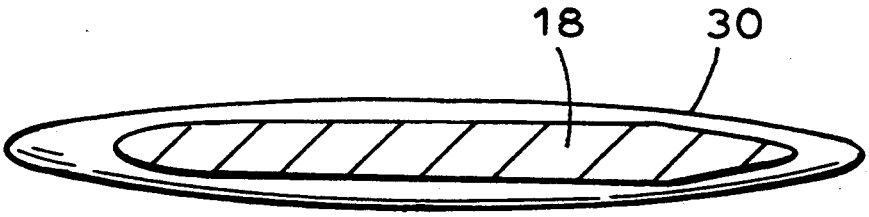
FIG. 14 is a sectional view similar to FIG. 12 of another embodiment of the invention wherein the buoyancy pod completely surrounds the strut.

In the embodiment of the invention as illustrated in FIG. 12, the forward pod 30 is mounted to the strut 18 on its forward edge 24 and its maximum width dimension is substantially equal to the width dimension of the strut. If desired, the pod may be wider and extend rearwardly from the front edge 24 to a side portion of the strut as in FIG. 14. As seen in FIG. 14 pod 30 has a wider width than the leading edge 24 of the strut sections below it and thus serves as a spray deflector for the spray generated by the strut. In addition, due to its diamond shape, the pod cuts through the waves with relatively minimal resistance.

In calm seas the forward pods are situated above the water and thus there is no contribution by the buoyancy pods to motion of the vessel or resistance of such motion. At rest and at design speed in calm seas, the pods provide reserve water plane area and buoyancy to counteract trim and heeling due to weight shifts and other forces. The forward pods are especially effective in counteracting negative bow trim due to the large moment arm developed from the far forward buoyancy pod location. They are also very effective in counteracting heeling due to the large moment arm of the pod water plane area outboard of the strut.

In unusual sea conditions waves may encounter the pod. The pods pierce the waves and become submerged. As a result of the Froude-Krylov forces and added mass damping, the pod minimizes motions of the vessel. Streamlining the pod results in minimum increases to resistance when the pod enters the water.

Again, the provision of the pods allows the sponsons to be designed with less flair and thus there are fewer incidents of slamming of the waves into the sponson structure. In long large waves the pods counteract heave motions.

As also seen in FIG. 12 rear buoyancy pods 32 have a similar configuration to forward buoyancy pods 30, i.e. they are diamond shaped in cross section and taper to a wave piercing tip. These pods are also located at the trailing or aft edge of the struts above or at the design water line slightly lower than the forward pods as described above. Here again in the illustrated embodiment the pods have a width equal to the width of the strut, but they can be wider than the strut, if desired, and extend toward the midsection of the strut. In the embodiment seen in FIG. 12, the pod is wider than the aft section 26 of the strut and thus serves as a spray deflector.

At operating speeds the rear pod is ventilated through the trough of the bow wave and thus makes little contribution to the motions or the resistance of movement of the vessel. At rest and at operating speed the pods provide reserve water plane area and buoyancy to counteract trim and heeling due to weight shift and other forces. The rear pods are especially effective in counteracting stern down trim due to the large moment arm of the pod location aft of the trailing edge. They are also very effective in counteracting heel due to the large moment arm of the water plane outboard of the strut.

In waves from all headings, but especially following seas, the rear pods pierce the waves and become submerged. As a result of the Froude-Krylov forces and the added mass of the pods dampening is produced to reduce motions of the vessel.

The streamline nature of the pods result in a minimum increase in resistance and also permits the sponsons to be designed with less flair. As an additional advantage, in long large waves the rear pods counteract heave motions.

Figure 6:
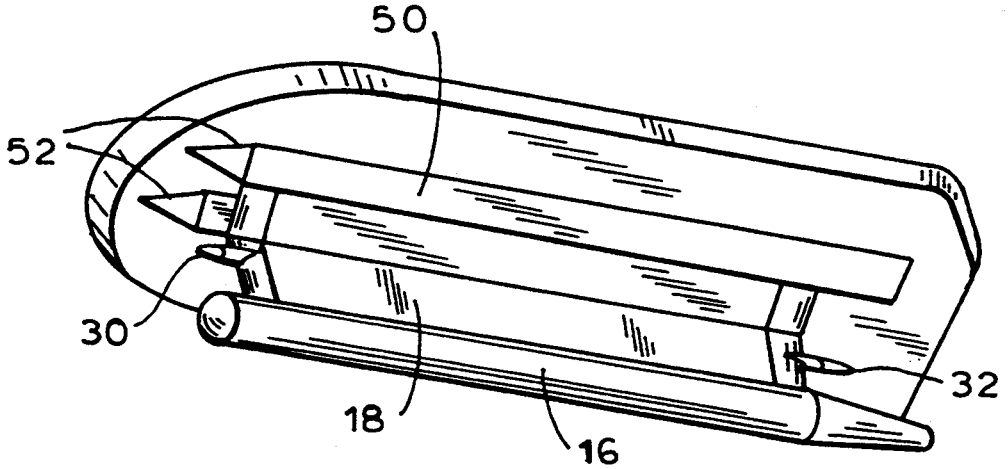
FIG. 6 is a perspective of a SWAS vessel having a single submerged hull constructed in accordance with the present invention.

The provisions of buoyancy pods 30, 32 on the struts can be adapted to a variety of SWAS vessel constructions. For example, as shown in the embodiment of FIG. 6, a SWAS vessel having a single submerged hull is provided along with a single strut 18. Buoyancy pods 30 and 32 are provided at opposite ends of the strut. In this case the strut is connected by a flared rigid membrane 50 to sponsons 52.

Figure 8:
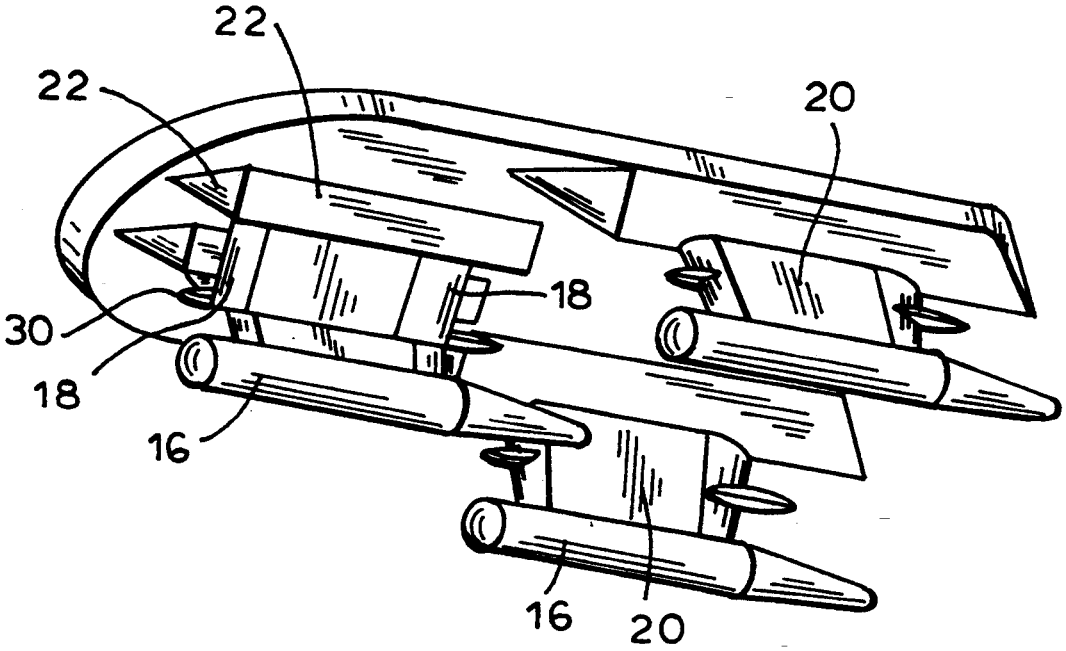
FIG. 8 is a perspective from below of a SWAS vessel having three submerged hulls.
Figure 9:
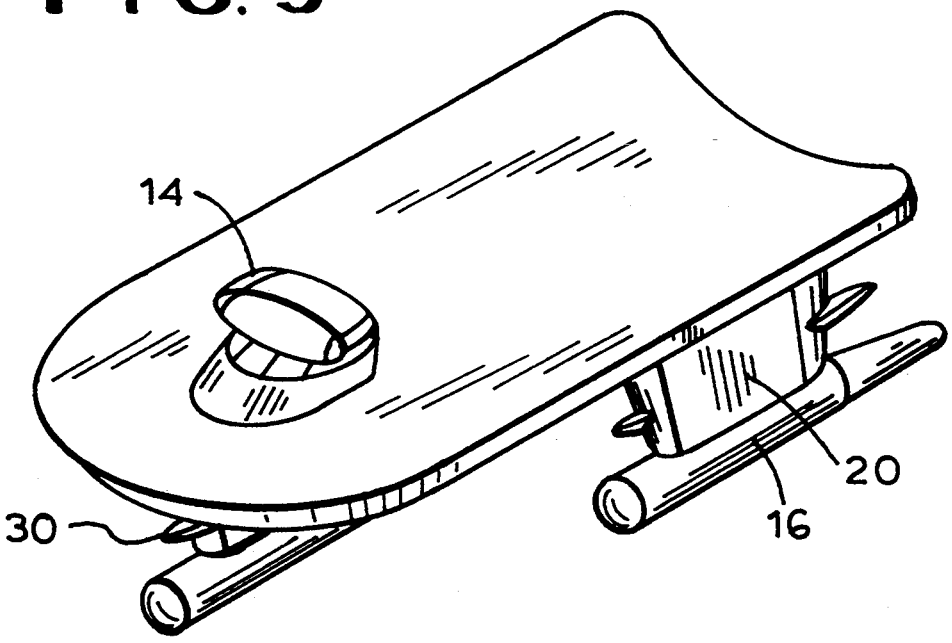
FIG. 9 is a perspective view from above of the vessel in FIG. 8.

In the embodiment of the invention illustrated in FIG. 8 a SWAS vessel is provided having three submerged hulls 16 connected by struts 18, 20. Again each strut has forward and aft buoyancy pods secured thereto. In this embodiment the forward strut is asociated with a pair of sponsons 22. The upper portion of the forward strut 18, above the bouyancy pods 30, is defined by two strut sections 181 which flare outwardly from the waterline to the sponsons to provide even greater waterplane areas on the forward strut.

Figure 13:
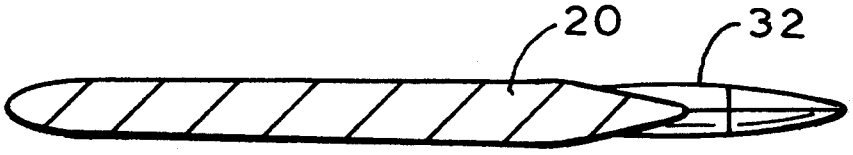
FIG. 13 is a sectional view similar to FIG. 12 of an embodiment of the invention having only an aft buoyancy pod.

The buoyancy pods can be provided on the struts of these vessels in multiple patterns, depending upon the particular use to which the vessel is to be placed. For example, as illustrated in FIG. 13 a strut 20 may be provided with only rear buoyancy pods 32.

Figure 10:
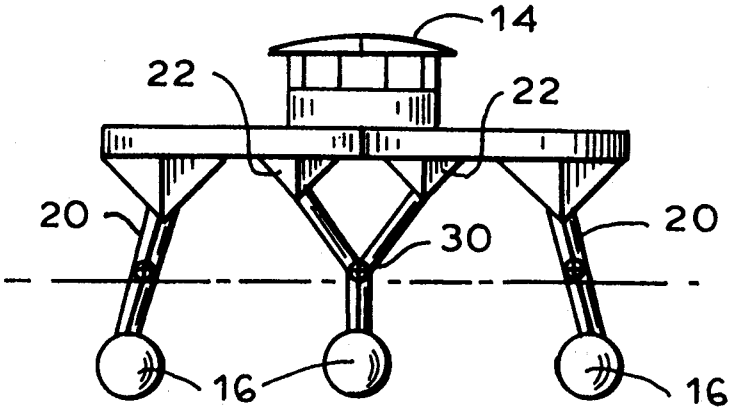
FIG. 10 is a front view of the vessel in FIG. 8.
Figure 11:
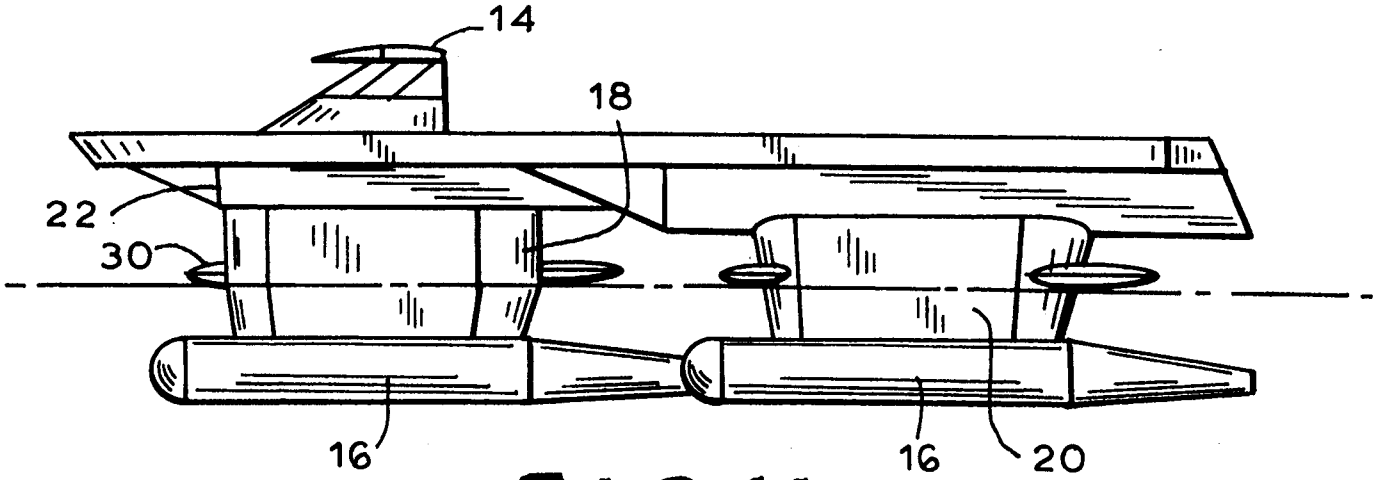
FIG. 11 is a side view of the vessel shown in FIG. 8.
Figure 15:
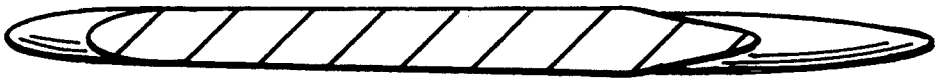
FIG. 15 is a sectional view taken along line 15—15 of FIG. 8 showing generally conically shaped fore and aft buoyancy pods.

The pods may also be shaped in other configurations, such as illustrated in FIGS. 6 and 8, wherein they are generally conically shaped (see FIGS. 10 and 15) rather than diamond shaped. In addition, rather than being located simply at the leading and trailing edges of the struts, the pods can fully encompass the struts at the water plane area thereof as illustrated in FIG. 14.

Figure 7:
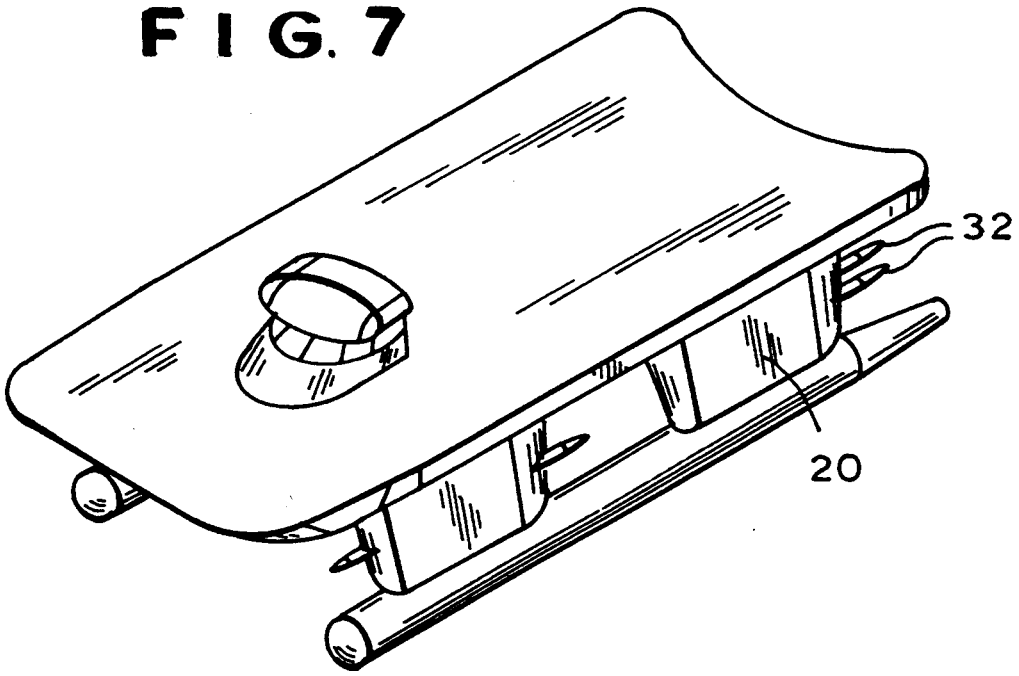
FIG. 7 is a perspective from above of a SWAS/-SWATH vessel similar to that shown in FIG. 2 having multiple buoyancy pods on a strut.

In another embodiment of the invention, illustrated in FIG. 7, multiple buoyancy pods can be placed on a strut. In this embodiment, multiple rear pods 32 are positioned at spaced locations from each other on rear strut 20. Such multiple positioning of the pods can be accomplished with or without a companion forward pod. In addition, multiple forward pods can be provided.

Figure 16:
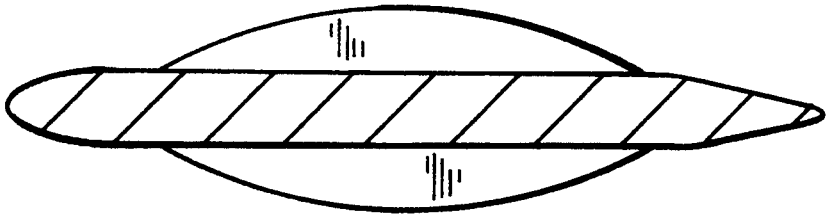
FIG. 16 is a sectional view similar to FIG. 15 of another embodiment of the invention where the buoyancy pods are located on opposite sides of the strut.
Figure 17:
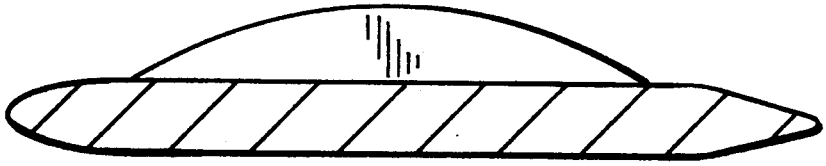
FIG. 17 is a sectional view similar to FIG. 16 of an embodiment of the invention wherein a buoyancy pod is located on one side of a strut.

The buoyancy pods of the invention may be located symmetrically fore and aft on a strut or nonsymmetrically as illustrated in FIG. 7 wherein no forward pod is provided on the rear strut 20. They also may be located symmetrically on opposite sides of the strut, as illustrated in FIG. 16, or on one side of the strut as illustrated in FIG. 17.

Figure 18:
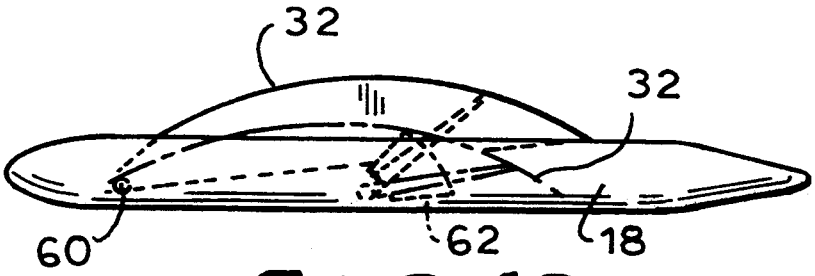
FIGS. 18 and 19 are sectional views similar to FIG. 17 illustrating an embodiment of the invention wherein adjustable buoyancy pods are provided.

In accordance with another embodiment of the invention, the position of the buoyancy pods can be adjusted relative to the strut. For example, as illustrated in FIG. 18, a buoyancy pod 32 is located in the midsection of the strut 18 and is pivotally mounted at 60 within the strut structure. A hydraulic ram 62 or the like is connected between the strut and the pod 32 to move it from the phantom line position wherein it is substantially fully retracted within the strut to the solid, line position wherein it is extended.

Figure 19:
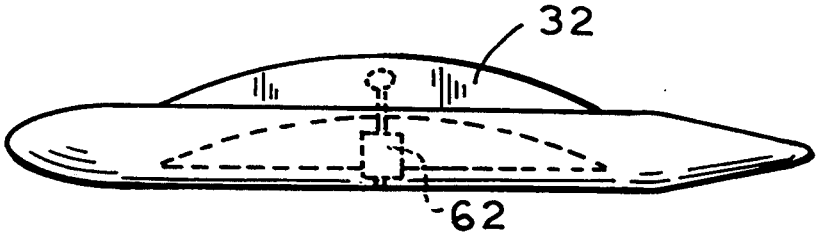

In another embodiment, illustrated in FIG. 19, the pod 32 is mounted to slide directly inwardly and outwardly under the influence of ram 62 from the dotted line position thereof to the solid position. Other arrangements can also be provided to vary the pitch of the pod relative to the strut if desired.

Figure 5:
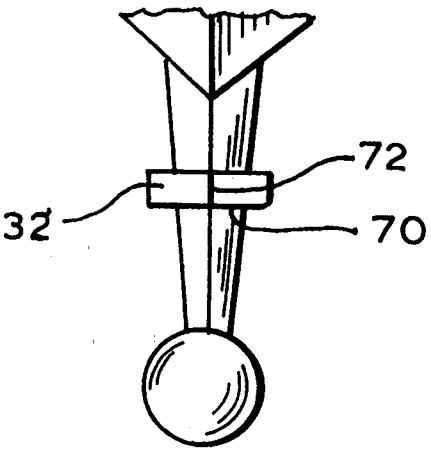
FIG. 5 is a front view of one strut of a SWAS vessel showing a rectilinearly shaped buoyancy pod.

A further pod configuration is illustrated in FIG. 5 which substantially surrounds strut 18, in a manner similar to that of the embodiment in FIG. 14. In this embodiment however pod 32 has flat surfaces 70 defining a leading edge 72 to form a wave piercing structure. It also has a flat lower surface 74 to deflect spray.

Accordingly it is seen that by this invention, a great degree of flexibility in designing the characteristics of a SWAS vessel is provided. The buoyancy pods increase buoyancy when the vessel heels or lists, to resist further movement of the vessel and to provide an additional safety factor. Also the struts and pods having minimum effect in normal dynamic operation of the vessel.

The modifications and variations of geometry and positioning of the buoyancy pods for the SWAS vessel as described above also permit the construction of more stable vessels capable of operating in a greater variety of sea conditions and have improved safety factors.

Although illustrative embodiments of the present invention have been described herein with reference to the accompanying drawings, it is to be understood that various changes and modification may be effected therein by those skilled in the art without departing from the scope or spirit of this invention.

What is claimed is:

1. A self-propelled small water plane area vessel comprising at least one normally submerged hull which is submerged when the vessel is at rest and underway, a superstructure normally located above the level of the water during operation of the vessel and at least one strut connecting said superstructure to said submerged hull, said vessel having a design draft waterline located between said normally submerged hull and said superstructure and at least one buoyancy pod on said at least one strut located above the design draft waterline and below said superstructure, said at least one buoyancy pod and strut having a combined water plane area at the waterplane of the pod which is larger than the water plane areas of said at least one strut above and below the pod and smaller than the water plane area of the submerged hull.

2. A small water plane area vessel as defined in claim 1 wherein said pod extends forwardly of said strut.

3. A small water plane area vessel as defined in claim 2 wherein said pod has a wave piercing shape.

4. A small water plane area vessel as defined in claim 1 wherein said strut has a chord length above said pod which is greater than its chord length below the pod.

5. A small water plane area vessel as defined in claim 2 wherein said pod includes a rear portion extending rearwardly beyond the strut.

6. A small water plane area vessel as defined in claim 1 including a plurality of separate buoyancy pods on said at least one strut located above the design draft water line.

7. A small water plane area vessel as defined in claim 1 wherein said at least one strut has a leading edge and said pod has a leading edge with a width dimension greater than that of the leading edge of the strut.

8. A small water plane area vessel as defined in claim 1 wherein said strut has opposite sides and said pod extends beyond one of said sides.

9. A small water plane area vessel as defined in claim 1 including means for varying the position of the pod relative to the strut.

10. A small water plane area vessel as defined in claim 1 wherein said pod is located above the draft design water line by a dimension substantially equal to the height of the bow wave formed by the strut at design speed.

11. A small water plane area vessel as defined in claim 1 wherein said pod is diamond shaped in vertical cross section transverse to the strut.

12. A small water plane area vessel as defined in claim 1 wherein said pod is generally conically shaped.

13. A small water plane area vessel as defined in claim 1 including a plurality of buoyancy pods located on said at least one strut between said hull and said superstructure.

14. A small water plane area vessel as defined in claim 13 wherein said pods are located between said draft design water line and said superstructure.

15. A self-propelled small water plane area vessel comprising a plurality of normally submerged hulls which are submerged when the vessel is at rest and underway, a superstructure normally located above the level of the water during operation of the vessel and a plurality of struts connecting said superstructure to said submerged hulls and including at least one strut connecting each hull to the superstructure, said vessel having a design draft waterline located between said normally submerged hulls and said superstructure and at least one buoyancy pod on at least one of said struts and being located above the design draft waterline and below said superstructure, said at least one of said struts and said at least one buoyancy pod thereon having a combined water plane area at the waterplane of the pod which is larger than the water plane areas of the strut above and below the pod and smaller than the water plane area of the submerged hull to which it is connected.

16. A small water plane area vessel as defined in claim 15 wherein said at least one of said struts having a buoyancy pod thereon includes a leading edge and said pod includes a portion extending forwardly of said leading edge.

17. A small water plane area vessel as defined in claim 15 wherein said at least one of said struts having a buoyancy pod thereon includes a trailing edge and said pod includes a portion extending rearwardly of said trailing edge.

18. A small water plane area vessel as defined in claim 15 wherein said at least one of said struts having a buoyancy pod thereon includes leading and trailing edges and said pod is located only between said edges.

19. A small water plane area vessel as defined in claim 15 wherein said at least one of said struts having a buoyancy pod thereon has opposed port and starboard sides.

20. A small water plane area vessel as defined in claim 19 wherein said pod is symmetrical with respect to said sides.

21. A small water plane area vessel as defined in claim 19 wherein said pod is located only along one of said sides.

22. A small water plane area vessel as defined in claim 15 wherein said pod has a wave piercing shape.

23. A small water plane area vessel as defined in claim 22 wherein said pod is diamond shaped in vertical cross section transverse to the strut.

24. A small water plane area vessel as defined in claim 22 wherein said pod is generally conically shaped.

25. A small water plane area vessel as defined in claim 15 wherein said at least one of said struts having a buoyancy pod thereon has a chord length above said pod which is greater than its chord length below the pod.

26. A small water plane area vessel as defined in claim 15 including a plurality of buoyancy pods on said at least one strut located above the design draft water line.

27. A small water plane area vessel as defined in claim 15 wherein said at least one strut has a leading edge and said pod has a leading edge with a width dimension greater than that of the leading edge of the strut.

28. A small water plane area vessel as defined in claim 15 including means for varying the position of the pod relative to the strut.

29. A small water plane area vessel as defined in claim 15 wherein said pod is located above the draft design water line by a dimension substantially equal to the height of the bow wave formed by the strut at design speed.

30. A small water plane area vessel as defined in claim 15 including a plurality of buoyancy pods located on said at least one strut between said hull and said superstructure.

31. A small water plane area vessel as defined in claim 15 wherein said at least one of said struts having a buoyancy pod thereon includes leading and trailing edges and said pod comprises a first buoyancy pod section at the leading edge of the strut and a second separate an independent buoyancy pod section at the trailing edge of the strut.

* * * * *